United States Patent [19]

Fudickar et al.

[11] 4,426,573

[45] Jan. 17, 1984

[54] PTC HEATING ELEMENT

[75] Inventors: Carl S. Fudickar, Solingen-Gräfrath; Peter Thies, Ennepetal-Voerde, both of Fed. Rep. of Germany

[73] Assignee: C. S. Fudickar K.G., Wuppertal, Fed. Rep. of Germany

[21] Appl. No.: 329,571

[22] Filed: Dec. 10, 1981

[30] Foreign Application Priority Data

Dec. 13, 1980 [DE] Fed. Rep. of Germany ..... 3046995
Apr. 16, 1981 [DE] Fed. Rep. of Germany ..... 3115396

[51] Int. Cl.[3] ..... H05B 3/02

[52] U.S. Cl. ..... 219/544; 219/243; 219/530; 219/541; 219/553; 53/463; 53/557; 338/22 R; 100/93 P; 219/505

[58] Field of Search ..... 219/243, 245, 353, 388, 219/505, 523, 530, 540, 535, 541, 544, 553; 53/463, 479, 557; 100/93 P; 156/358, 583; 338/22 R, 22 S

[56] References Cited

U.S. PATENT DOCUMENTS

| | | | |
|---|---|---|---|
| 3,748,439 | 7/1973 | Ting et al. | 219/353 |
| 3,996,447 | 12/1976 | Bouffard et al. | 219/541 |
| 4,086,467 | 4/1978 | Grant | 219/544 |
| 4,091,267 | 5/1978 | Grant | 219/544 |
| 4,104,509 | 8/1978 | Van Bokestal et al. | 219/544 |
| 4,147,927 | 4/1979 | Pirotti et al. | 219/541 |
| 4,230,935 | 10/1980 | Maixner | 219/523 |
| 4,236,065 | 11/1980 | Yashin et al. | 219/544 |
| 4,242,567 | 12/1980 | Carter | 219/505 X |
| 4,327,282 | 4/1982 | Nauerth | 219/541 |

*Primary Examiner*—Volodymyr Y. Mayewsky
*Attorney, Agent, or Firm*—Karl F. Ross; Herbert Dubno

[57] ABSTRACT

A heating element comprises an electrically nonconducting support body having a pair of opposite faces and formed with a plurality of throughgoing holes opening at the faces, respective electrically energizable heating capsules in the holes and each having one end exposed at one of the faces and an opposite end exposed at the other of the faces, and a pair of respective conductors lying on the faces in electrical contact with the respective exposed ends of the capsules. A tight hermetic skin surrounds and encapsulates the body with the capsules in the holes and the conductors on the faces. A pair of respective wires extending through the skin and connected to the conductors serve for passing electricity through the heating capsules. The skin effectively protects the assembly from moisture when installed in a heater. In addition this skin protects the heating element prior to installation and can in fact eliminate the need for a shipping package.

8 Claims, 8 Drawing Figures

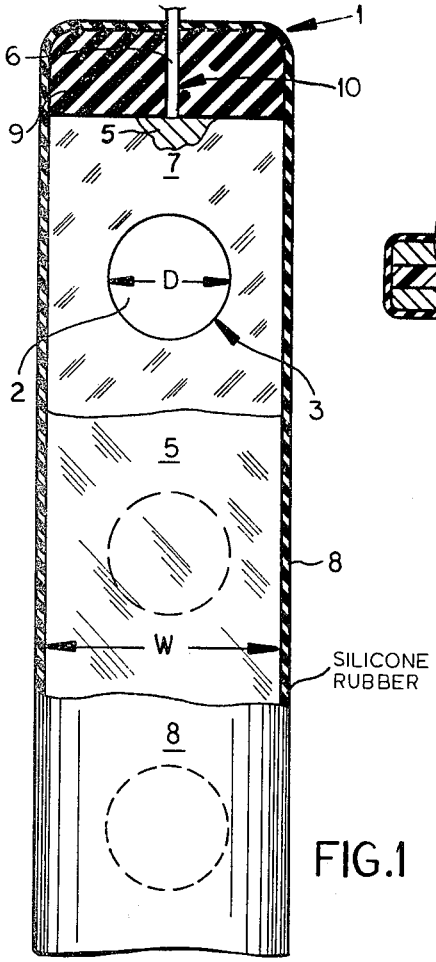
FIG.1
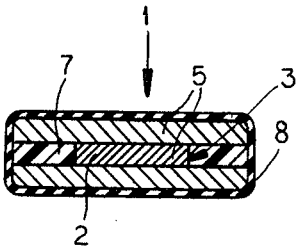
FIG.3
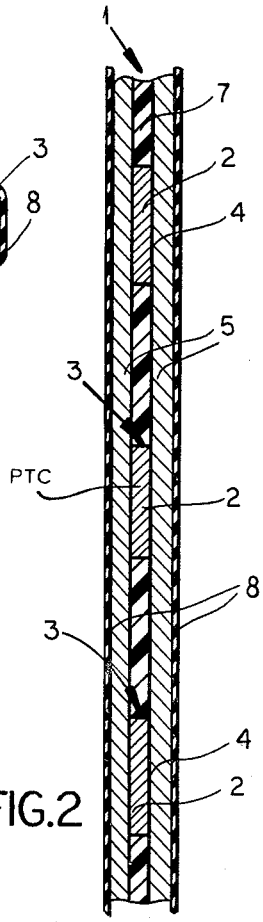
FIG.2
FIG.4
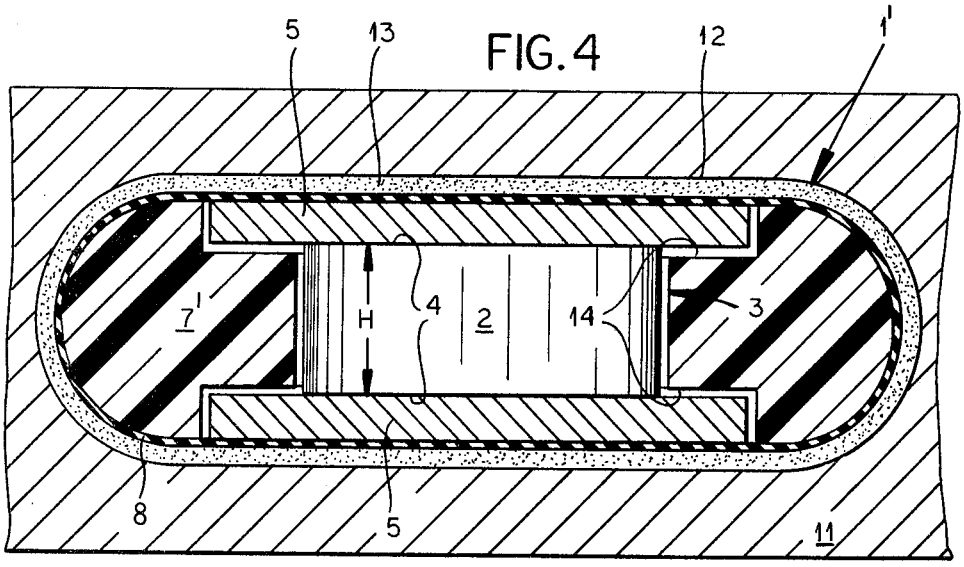

PTC HEATING ELEMENT

FIELD OF THE INVENTION

The present invention relates to a heating element and method of making the heating element. More particularly this invention concerns a heating element of the low-temperature (i.e. 100° C.–200° C.) type used in a platen of a press, in a household appliance, in a heater, or the like.

BACKGROUND OF THE INVENTION

A platen press is heated by heating elements that are built into the press platens. Heating capsules, normally of an automatically self-temperature-stabilizing PTC ceramic whose resistance increases as its temperature rises to a predetermined level, are mounted in the platen. Conductors are connected to the ends of these capsules so that electricity can be passed through them to energize them. Typically separate ceramic or ceramic-lined seats are provided for the capsules, and separate conductors for the requisite electrical connections are required.

Such construction is relatively complex and difficult. In addition such a heating element is extremely susceptible to damage by moisture. Any moisture that gets into the heating element will quickly create corrosion due to the high temperature and presence of electricity. In fact such platens have a woefully short service life whenever employed in wet environments, or when used to press objects that generate steam when pressed, as for instant in a belt-manufacturing or -repair press.

The same problems also mitigate against any use of this type of heater in a household appliance, as such a heater is useless if it cannot be used where steam is generated and or if it cannot be thoroughly washed.

Another difficulty with this type of heating element is that replacing it is an onerous job. In fact if the heating element incorporated in a heater such as a platen press fails it is necessary to disassemble the heater and do extensive complex work to replace even a small portion of the heating element, much less all of it. The down time for such repair in an industrial application is considerable.

OBJECTS OF THE INVENTION

It is therefore an object of the present invention to provide an improved heating element and method of making same.

Another object is the provision of such a heating element and method of making same which overcome the above-given disadvantages.

A further object is the provision of such a heating element which is not moisture sensitive and which is easy to service or replace.

SUMMARY OF THE INVENTION

These objects are attained according to the instant invention in a heating element comprising an electrically nonconducting support body having a pair of opposite faces and formed with a plurality of throughgoing holes opening at the faces, respective electrically energizable heating capsules in the holes and each having one end exposed at one of the faces and an opposite end exposed at the other of the faces, and a pair of respective conductors lying on the faces in electrical contact with the respective exposed ends of the capsules. According to this invention a tight hermetic skin surrounds and encapsulates the body with the capsules in the holes and the conductors on the faces. Means including a pair of respective wires extending through the skin and connected to the conductors serves for passing electricity through the heating capsules.

The skin according to the instant invention therefore effectively protects the assembly from moisture when installed in a heater. In addition this skin protects the heating element prior to installation and can in fact eliminate the need for a shipping package. The conductors are, like the skin, also durable and flexible according to this invention so that they protect the heating capsules.

According to another feature of this invention the conductors are made of a metallic foil that underlies the skin. In this instance the skin is elastic and urges the conductors into snug engagement with the ends of the heating capsules.

The skin in accordance with the invention is of silicone rubber. This material is relatively heat resistant and forms an effective vapor barrier, while still remaining supple and providing relatively good mechanical protection for the subassembly constituted by the support body, capsules, and conductors it encapsulates. What is more silicone rubber is relatively inexpensive, and easy to shape and otherwise use in manufacturing processes.

When the heating element according to the instant invention is mounted in a cavity of a heater such as a press platen, it is surrounded by a heat-conducting mass so that heat is effectively passed from the heat element to the heater.

Such a heating element is made according to the instant invention by a method comprising the steps of sequentially outwardly and transversely stretching an elastomeric tube to increase the inside diameter thereof, then inserting into the stretched tube a subassembly comprising the body with the capsules in the holes, the conductors on the faces, and the wires extending from the conductors, so that the subassembly lies wholly within the stretched tube with the wires extending therefrom. The tube is then relaxed around the subassembly and the ends of the tube are sealed to either side of the assembly to form the skin around the subassembly.

In accordance with this invention the tube is outwardly and transversely stretched by sequentially fitting the tube through a rigid sleeve having an inside diameter substantially larger than the outside diameter of the tube in relaxed condition, tightly securing the ends of the tube to the ends of the sleeve, and evacuating the space between the tube and the sleeve to adhere the tube against the inside surface of the sleeve. If the tube is particularly tough, it can be pressed against the inside surface of the sleeve by internally pressurizing it in which case the subatmospheric pressure in the space between the inside surface and the tube serves mainly to hold it in place.

The heating element according to this invention is therefore a heating strip which can be relatively flexible so that it can even be fitted to a nonstraight support. Since it is a wholly enclosed unit, it can even be used in household appliances, such as food warmers or cookers, where it is likely to be subject to considerable abuse, and where the application requires the device to be as safe as possible.

DESCRIPTION OF THE DRAWING

The above and other features and advantages will become more readily apparent from the following, reference being made to the accompanying drawing in which:

FIG. 1 is a side view partly broken away of a heating element according to this invention;

FIG. 2 is a longitudinal section through the element of FIG. 1;

FIG. 3 is a cross section through the element of FIG. 1;

FIG. 4 is a large-scale cross section through a heater incorporating another heating element according to the present invention.

SPECIFIC DESCRIPTION

Figure 5:
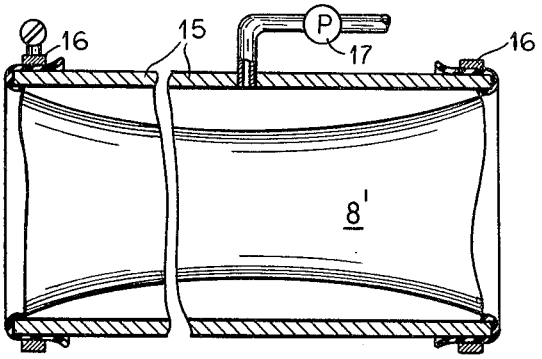
FIGS. 5–8 are largely schematic views illustrating the manufacture of the heating element of FIG. 1.

As seen in the drawing a heating element 1 according to the instant invention has a plurality of short cylindrical heating capasules 2 of a self-temperature-stabilizing PTC ceramic whose resistance increases as its temperature increases to a predetermined level, normally between 200° C. and 100° C. These capsules 2 have an axial height H and radial diameter D and are received in cylindrical throughgoing holes 3 formed in a support body or strip 7 formed of a heat-resistant and stiff but flexible synthetic resin that does not conduct electricity but that may be heat-conductive. As seen in FIGS. 1–3 this strip 7 has a width W equal to slightly more than twice the capsule diameter D and a thickness equal to slightly less than the capsule height H so that end faces 4 of the capsules 2 are exposed at the opposite flat faces of the strip 7.

Each generally planar face of the support 7 is covered by a respective electrically conductive metallic strip 5 each connected in turn to a respective feed wire 6. The strips 5 are of the same width W as the support 7 and extend the full length thereof.

Completely surrounding and encapsulating the subassembly formed by the parts 2, 5, and 7 is a tough skin 8 of silicone rubber. Each end of the subassembly is sealed by a plug 9 of silicone rubber sealed to the skin 8 or even formed simply by fusing together the skin 8 at these ends. These plugs 9 therefore form passages 10 through which the conductors 6 pass. This skin is prestressed in tension, so that it presses the conductors 5 against the opposite axial ends 4 of the row of longitudinally equispaced heating capsules.

FIG. 4 shows another such heating element 1' which is substantially identical to that of FIGS. 1–3 except that here the support body or strip 7' is formed on its opposite flat faces with longitudinally extending grooves 14 in which the conductors 5 are recessed. For such use the strip 7' to either side of the grooves 14 is of a thickness equal to slightly less than the height H plus the thickness of the two conductors 5. The entire subassembly formed by the parts 2, 5, and 7' is encapsulated in a silicone-rubber skin 8.

In addition the heating element 1' is shown received in a complementarily shaped but slightly larger passage 12 formed in a massive metallic press platen 11. To this end a conductive mass 13 of metal powder, metal strips, or the like fills the space between the skin 8 and the inner surface of the passage 12.

As seen in FIG. 5 the heating element 1 is made by first fitting an elastomeric sleeve 8' through a cylindrical tube 15 of substantially greater inside diameter than the outside diameter of the tube 8'. The ends of the tube 8' are stretched out and secured tightly to the outside of the sleeve 15 at the ends thereof by clamps 16.

Figure 6:
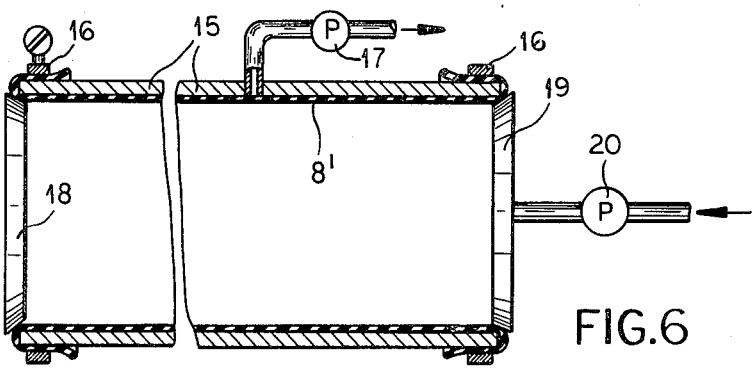

Then as seen in FIG. 6 a pump 17 evacuates the space between the outside of the tube 8' and the inside of the sleeve 15. Simultaneously the ends of the tube 18 may be blocked by plugs 18 and 19 and a further pump 20 can force a gas into the interior of the tube 8' to urge it flatly against the inside surface of the sleeve 15. This operation therefore effectively outwardly and transversely stretches the elastomeric tube to increase its inside diameter, not exceeding the elastic limit of the tube, however, so that it will return afterward to its original size.

Figure 7:
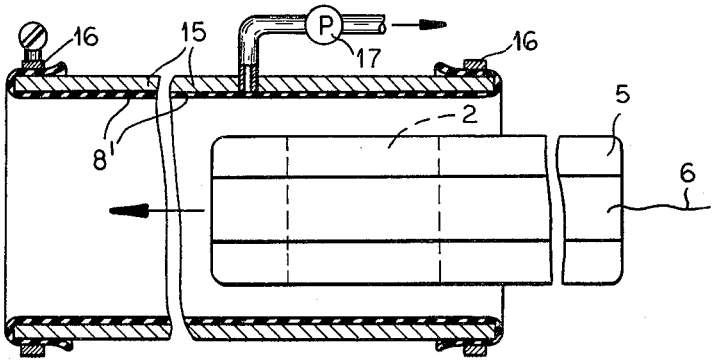

FIG. 7 shows how a subassembly formed of the support 7 carrying the capsules 2 in its holes 3 and the conductors 5 with their wires 6 is inserted axially into the stretched-out tube 8'. This tube 8' is somewhat longer than the subassembly inserted into it.

Figure 8:
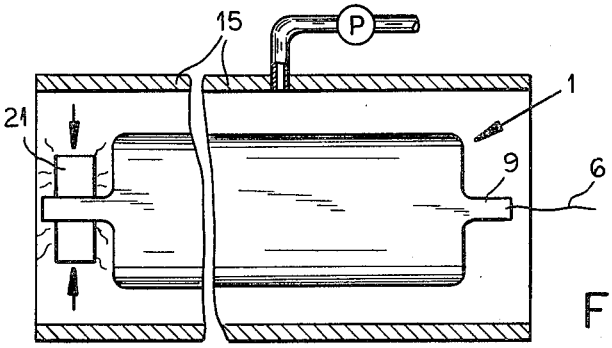

Finally as seen in FIG. 8 the ends of the tube 8' are released from the clamps 16 so that this tube relaxes down to its normal smaller-diameter size, snugly engaged around the subassembly of the parts 2, 5, and 7. A welding tool 21 then grips the sticking-out ends of the tube 8' to seal them together at 9 and form the completed heating element 1.

The heating element according to the instant invention is therefore completely self-contained. All of its parts are hermetically sealed so that the element can easily be used in wet environments. The skin not only protects the arrangement in use, but can indeed serve as its packaging, bearing indicia identifying the product, so as to eliminate the need for a separate container. The conductors similarly protect the capsules 2 both before and during use. Finally the support 7 or 7' is normally flexible enough to allow the heating element to be bent into a curved or twisted shape. In virtually any position the tight elastomeric skin will press the conductors flatly against the ends of the heating capsules to insure excellent electrical contact. Even though bending the assembly according to this invention will cause limited slippage between the conductors and the capsules, this slippage will not in any way destroy the good electrical connection between them.

We claim:

1. A heating element comprising:

an electrically nonconducting support body having a pair of opposite faces and formed with a plurality of throughgoing holes opening at said faces;

respective electrically energizable heating capsules in said holes and each having one end exposed at one of said faces and an opposite end exposed at the other of said faces;

a pair of respective conductors lying on said faces in electrical contact with the respective exposed ends of said capsules;

a tight heat conductive and electrically nonconductive skin surrounding and encapsulating said body with said capsules in said holes and said conductors on said faces, said skin being elastic and urging said conductors into snug engagement with said ends of said heating capsules; and means including a pair of respective wires extending through said skin and connected to said conductors for passing electricity through said heating capsules.

2. The heating element defined in claim 1 wherein said skin is durable and flexible.

3. The heating element defined in claim 1 wherein said conductors are durable and flexible.

4. The heating element defined in claim 1 wherein said skin is of silicone rubber.

5. The heating element defined in claim 4 wherein said skin is formed as a tube with sealed ends, said wires extending through one of said ends of said skin.

6. The heating element defined in claim 1 further comprising a heat-conducting mass surrounding said skin, whereby when said element is mounted in a cavity of a press platen or the like said mass conducts heat thereto.

7. The heating element defined in claim 1 wherein the ends of said capsules normally project slightly past the respective faces of said support body.

8. The heating element defined in claim 1 wherein the ends of the capsules bear against and are limitedly shiftable on the respective conductors.

* * * * *